US007369028B2

(12) United States Patent
Matsunaga et al.

(10) Patent No.: US 7,369,028 B2
(45) Date of Patent: May 6, 2008

(54) COIL COMPONENT

(75) Inventors: Minoru Matsunaga, Echizen (JP); Masahiko Kawaguchi, Machida (JP); Katsuji Matsuta, Yokohama (JP); Kazuhide Kudo, Sagamihara (JP); Kenichi Ito, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/743,271

(22) Filed: May 2, 2007

(65) Prior Publication Data

US 2007/0205856 A1 Sep. 6, 2007

Related U.S. Application Data

(63) Continuation of application No. PCT/JP2005/018950, filed on Oct. 14, 2005.

(30) Foreign Application Priority Data

Nov. 25, 2004 (JP) ..... 2004-340140
Jun. 15, 2005 (JP) ..... 2005-175112

(51) Int. Cl.
*H01F 5/00* (2006.01)

(52) U.S. Cl. ..... 336/200

(58) Field of Classification Search ..... 336/65, 336/83, 200, 220–222, 232, 208; 257/531
See application file for complete search history.

(56) References Cited

U.S. PATENT DOCUMENTS 3,785,046 A * 1/1974 Jennings ..... 29/602.1
4,313,151 A * 1/1982 Vranken ..... 361/765
5,363,081 A * 11/1994 Bando et al. ..... 336/200
6,404,317 B1 * 6/2002 Mizoguchi et al. ..... 336/200
7,253,713 B2 * 8/2007 Tomonari et al. ..... 336/200

FOREIGN PATENT DOCUMENTS

| | | | |
|---|---|---|---|
| JP | 55-96605 | A | 7/1980 |
| JP | 05-291044 | A | 11/1993 |
| JP | 09-129458 | A | 5/1997 |
| JP | 10-004015 | A | 1/1998 |
| JP | 2002-151330 | A | 5/2002 |
| JP | 2003-217933 | A | 7/2003 |
| JP | 2004-095860 | A | 3/2004 |
| JP | 2004-311828 | A | 11/2004 |
| JP | 2004-339016 | A | 12/2004 |

OTHER PUBLICATIONS

Official Communication for PCT Application No. PCT/JP2005/018950; mailed Jan. 24, 2006.

* cited by examiner

*Primary Examiner*—Tuyen T. Nguyen
(74) *Attorney, Agent, or Firm*—Keating & Bennett, LLP

(57) ABSTRACT

A coil component includes a first coil block and a second coil block that are sandwiched between magnetic substrates so as to form a chip body, and external electrodes that are attached to the chip body. The first coil block includes a coil body and an insulating body. The coil body includes an outer coil portion and an inner coil portion. The outer coil portion includes a first pattern group and a second pattern group, which are connected helically vertically in an alternating fashion. The inner coil portion includes a first spiral pattern and a second spiral pattern, which are connected to each other in series. In other words, low stray capacitance is achieved by the outer coil portion, while high inductance is achieved by the inner coil portion.

8 Claims, 10 Drawing Sheets

COIL COMPONENT

BACKGROUND OF THE INVENTION

1. Field of the Invention

The present invention relates to coil components incorporated in, for example, electronic circuits, and more particularly, to a multilayer coil component used in a high-frequency circuit.

2. Description of the Related Art

A typical coil component incorporated in an electronic circuit of, for example, a cellular phone is shown in FIG. 12.

As shown in FIG. 12, a coil component 100 includes a multi-turn spiral pattern 101 disposed on an insulating layer 102, and an insulating layer 103 stacked on the spiral pattern 101. The insulating layer 103 includes an extending portion 104 thereon, which is connected to the spiral pattern 101 through a via hole 105.

Improvements in miniaturization and high inductance in coil components are in great demand in compliance with compactness of mobile communication devices, such as cellular phones. However, with the coil component 100 having the multi-turn spiral pattern 101 within a single layer, a sufficient number of turns for achieving high inductance cannot be obtained due to space limitations.

Consequently, a technology for obtaining a small-size high-inductance coil component by forming multilayer spiral patterns has been proposed, as shown in FIG. 13.

A coil component 200 shown in FIG. 13 is a multilayer type that includes two spiral patterns 201, 202 connected to each other in series in a stacking direction.

In detail, the first spiral pattern 201 is provided on the insulating layer 102, and the second spiral pattern 202 is provided on the insulating layer 103. Central portions of the spiral patterns 201, 202 are connected to each other through the via hole 105.

In this case, although the multilayer spiral pattern coil provides a sufficient number of turns and high inductance, the coil component 200 has higher stray capacitance as comparison to the coil component 100 shown in FIG. 12. In particular, a stray capacitance value produced in an outer peripheral portion of the coil is extremely high.

For example, as shown in FIG. 13, a line extending from an outermost periphery point P1 of the spiral pattern 201 to a point P2 of the spiral pattern 202 corresponding to the point P1 is equal to a sum of a path extending between the point P1 and a central portion 201*a* of the spiral pattern 201 and a path extending between a central portion 202*a* of the spiral pattern 202 and the point P2, such that the line is extremely long. Thus, a potential difference between the point P1 and the point P2 is large, and therefore, stray capacitance C200 produced between the point P1 and the point P2 is high. Such an increase in stray capacitance value leads to a decrease in self-resonance frequency of the coil component 200, thus deteriorating the high frequency property of the coil component 200.

In contrast, a multilayer coil component 300 that prevents an increase in stray capacitance has been proposed, as shown in FIG. 14 (see, for example, Japanese Unexamined Patent Application Publication No. 55-096605 (Patent Document 1) and Japanese Unexamined Patent Application Publication No. 5-291044 (Patent Document 2)).

The coil component 300 includes a pattern group 301 disposed on the insulating layer 102, and the insulating layer 103 stacked on the pattern group 301. The pattern group 301 includes rectangular annular patterns 311 to 316 that have overlapping opposite end segments and that are arranged substantially concentrically on the insulating layer 102. The coil component 300 also includes a pattern group 302 having rectangular annular patterns 321 to 326 that are arranged substantially concentrically on the insulating layer 103. The annular patterns 321 to 326 have non-overlapping end segments that are separated by a predetermined distance. First ends of the annular patterns 321 to 326 are connected to first ends of the annular patterns 311 to 316 through corresponding via holes 105*a* to 105*j* provided in the insulating layer 103.

Accordingly, for example, a line extending from an outermost peripheral point P1 of the pattern group 301 to a point P2 of the pattern group 302 corresponding to the point P1 is equal to a sum of a path extending between the point P1 and an end 311*a* of the annular pattern 311 and a path extending between an end 321*a* of the annular pattern 321 and the point P2, such that the line is extremely short. Therefore, a potential difference between the point P1 and the point P2 is small, whereby stray capacitance C300 produced between the point P1 and the point P2 is low.

However, although the stray capacitance can be reduced in the coil component 300 shown in FIG. 14, a sufficient number of turns for achieving high inductance cannot be obtained.

In other words, since the opposite end segments of the annular patterns 311 to 316 are arrayed in an overlapping manner, each annular pattern requires an area for disposing the corresponding opposite end segments in the arrayed direction of the opposite end segments (i.e. in a front direction closer to the viewer of FIG. 14). Therefore, due to space limitations, a sufficient number of annular patterns 311 to 316 cannot be obtained, which prevents the pattern group 301 from having a sufficient number of turns. Consequently, it is difficult to achieve high inductance of the coil component 300.

SUMMARY OF THE INVENTION

To overcome the problems described above, preferred embodiments of the present invention provide a coil component in which both low stray capacitance and high inductance are achieved.

A preferred embodiment of the present invention provides a coil component, which includes at least one coil block having a single coil body disposed within an insulating body, the single coil body including an inner coil portion and an outer coil portion, the inner coil portion being electrically connected to the outer coil portion and being surrounded by the outer coil portion. The outer coil portion includes a first pattern group and a second pattern group that are arranged facing each other. The first pattern group includes a plurality of annular patterns having different diameters and each having first and second opposite end segments, and also includes a first extending portion disposed outside of the plurality of annular patterns and having a first end segment that is exposed from the at least one coil block. The second pattern group includes a plurality of annular patterns having different diameters and each having first and second opposite end segments. The n-th annular pattern of the first pattern group from the outside thereof is helically connected to the n-th annular pattern of the second pattern group from the outside thereof via the first end segments. The second end segment of the n-th annular pattern of the first pattern group is connected to one of the end segments of the (n+1)-th annular pattern of the second pattern group such that the n-th and (n+1)-th annular patterns are helically connected to each other. The first extending portion has a second end segment that is connected to a free end segment of the outermost annular pattern of the second pattern group. The inner coil portion includes a first multi-turn spiral pattern and a second multi-turn spiral pattern. The first spiral pattern is disposed within the innermost annular pattern of the first pattern group and has an outer end segment that is connected to a free end segment of the innermost annular pattern of the second pattern group. The second spiral pattern is disposed within the innermost annular pattern of the second pattern group. The second spiral pattern has an inner end segment that is connected to an inner end segment of the first spiral pattern and also has a second extending portion having an outer end segment that is exposed from the at least one coil block.

Accordingly, when an electric current enters the first extending portion of the outer coil portion, the electric current flows into the outermost annular pattern (n=1) of the second pattern group. Subsequently, the electric current flows helically from this annular pattern in the second pattern group to the outermost annular pattern (n=1) of the first pattern group, and then flows helically from this annular pattern to an inner annular pattern (n=2) in the second pattern group. In a similar manner, the electric current helically flows through the annular patterns in the first pattern group and the annular patterns in the second pattern group in an alternating fashion until finally reaching the innermost annular pattern of the second pattern group. The electric current then enters the first spiral pattern of the inner coil portion, which is disposed within the outer coil portion and whose outer end segment is connected to the innermost annular pattern. The electric current flows inward through the first spiral pattern in a rotating fashion so as to enter the second spiral pattern whose inner end segment is connected to the inner end segment of the first spiral pattern. Subsequently, the electric current flows through the second spiral pattern outward in a rotating fashion so as to be output from the second extending portion. In other words, according to this coil component, the electric current flows helically through the outer coil portion and rotationally through the inner coil portion, whereby a magnetic field is generated in response to the rotating electric current. Thus, the coil component functions as an inductor.

Meanwhile, in a coil component having patterns that are disposed facing each other, stray capacitance generated between the patterns maybe of concern. In particular, stray capacitance generated between outer peripheral patterns that have large line lengths has a significant effect on a high frequency property of a coil component. In the coil component according to preferred embodiments of the present invention, however, because the outermost annular pattern (n=1) in the first pattern group of the outer coil portion is helically connected to the opposing outermost annular pattern (n=1) of the second pattern group, a line extending from the outermost annular pattern of the first pattern group to the outermost annular pattern of the second pattern group is extremely short. Thus, a voltage drop caused in the course of reaching the outermost annular pattern of the second pattern group is reduced, whereby a potential difference between the outermost annular pattern of the first pattern group and the outermost annular pattern of the second pattern group is reduced. Such a reduction of potential difference is achieved not only between the outermost annular patterns but also between other opposing annular patterns. As a result, in addition to the reduction of stray capacitance generated between these outermost annular patterns, the stray capacitance generated between all annular patterns included in the first and second pattern groups is reduced, thereby preventing a decrease in the self-resonance frequency.

Furthermore, because the inner coil portion including the first and second spiral patterns that are connected in series is disposed within the outer coil portion, the inner coil portion contributes to a high inductance, which cannot be achieved solely with the outer coil portion.

Preferably, a line length of the outer coil portion is set to at least about ⅓ of a line length of the single coil body. Accordingly, optimal values for both low stray capacitance and high inductance are obtained.

Preferably, the at least one coil block has a multilayer structure including a first insulating layer on which the first pattern group and the first spiral pattern are disposed, and a second insulating layer stacked on the first pattern group and the first spiral pattern, the second insulating layer having the second pattern group and the second spiral pattern disposed thereon. The second insulating layer includes a plurality of via holes through which the end segments of the annular patterns in the first pattern group are connected to the corresponding end segments of the annular patterns in the second pattern group, through which the outer end segment of the first spiral pattern is connected to the free end segment of the innermost annular pattern of the second pattern group, and through which the inner end segment of the second spiral pattern is connected to the inner end segment of the first spiral pattern.

Preferably, the at least one coil block is formed by a photolithography technique.

Although there are various layering techniques for forming the coil block, a photolithography technique may preferably be used for forming the coil block so that the stray capacitance and the line length can be controlled with high precision.

Preferably, the at least one coil block is disposed on a substrate.

Preferably, the at least one coil block includes a first coil block and a second coil block, the second coil block being stacked on the first coil block such that the coil body of the second coil block is coaxial with the coil body of the first coil block.

Accordingly, by incorporating the coil component in a high-speed differential transmission line, the coil component functions as a common-mode choke coil. In other words, in a normal mode, a first differential signal travels through the coil body of the first coil block, and a second differential signal in a direction opposite to the first differential signal travels through the coil body of the second coil block. In a common mode, although high frequency noise travels through the first and second coil blocks in the same direction, the noise is attenuated by the high inductance coils in the first and second coil blocks.

Preferably, the first coil block is disposed on a magnetic substrate, and another magnetic substrate is disposed on the second coil block.

Accordingly, this produces higher inductance of the coil component.

Preferably, the first pattern group and the first spiral pattern define a pattern unit in the coil body of each of the first and second coil blocks, and the second pattern group and the second spiral pattern define another pattern unit in the coil body of each of the first and second coil blocks, the second coil block being stacked on the first coil block such that one of the pattern units with a higher density in the second coil block is arranged so as to face one of the pattern units with a higher density in the first coil block.

Accordingly, this strengthens an electromagnetic coupling between the coil body of the first coil block and the coil body of the second coil block.

As described above, the coil component according to prefered embodiments of the present invention achieves lower stray capacitance, and prevents a decrease of the self-resonance frequency, whereby a favorable high frequency property is obtained. Furthermore, the inner coil portion produces a high inductance, which cannot be achieved solely with the outer coil portion. Therefore, the outer coil portion and the inner coil portion can be set to optimal line lengths, thereby advantageously achieving both low stray capacitance and high inductance.

In particular, since the line lenght of the outer coil portion may be set to at least about ⅓ of the line length of the single coil body, low stray capacitance and high inductance is optimally achieved.

Furthermore, since the coil block may be formed by a photolithography technique, the stray capacitance and the line length can be controlled with high precision, whereby low stray capacitance and high inductance can be achieved with even greater precision.

Furthermore, a coil component is provided that achieves low stray capacitance and high inductance and that functions as a common-mode choke coil.

In particular, a coil component that functions as an optimal common-mode choke coil for a high-speed differential transmission line of DVI standard or HDMI standard is provided.

In particular, since the electromagnetic coupling between the coil body of the first coil block and the coil body of the second coil block can be strengthened, if the coil component is used as, for example, a common-mode choke coil, the normal-mode impedance thereof can be reduced, whereby an insertion loss of a differential signal in a normal mode can be reduced. Accordingly, preferred embodiments of the present invention advantageously provides a common-mode choke coil that effectively removes only common-mode noise while preventing attenuation of a differential signal.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will now be described with reference to the drawings.

First Preferred Embodiment

Figure 1:
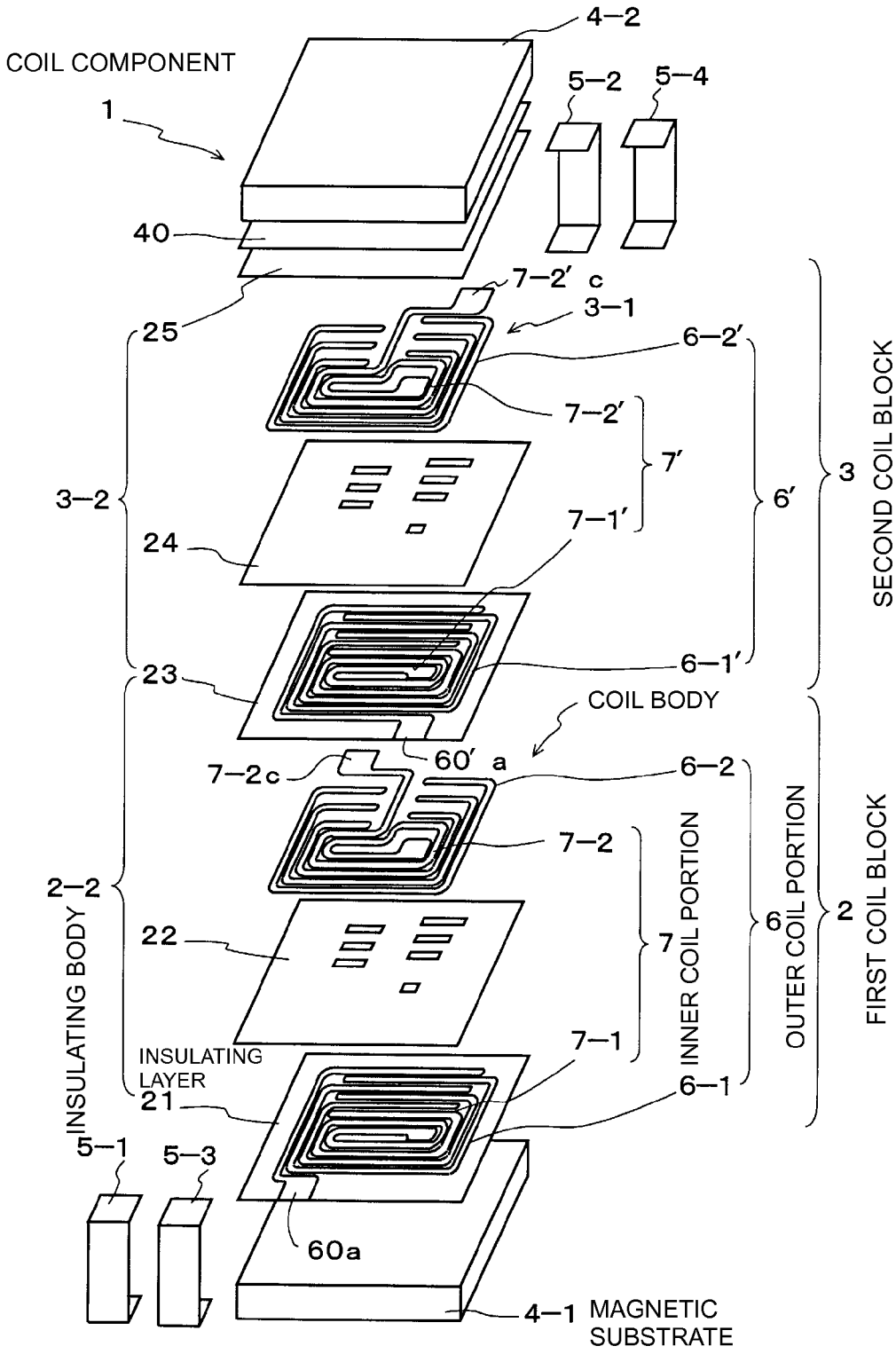
FIG. 1 is an exploded perspective view of a coil component according to a first preferred embodiment of the present invention.
Figure 2:
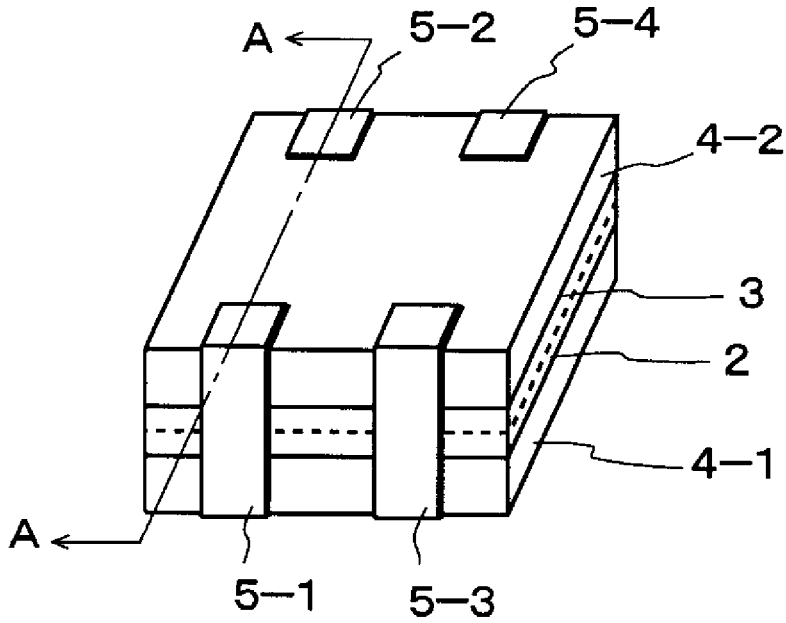
FIG. 2 is an external view of the coil component.
Figure 3:
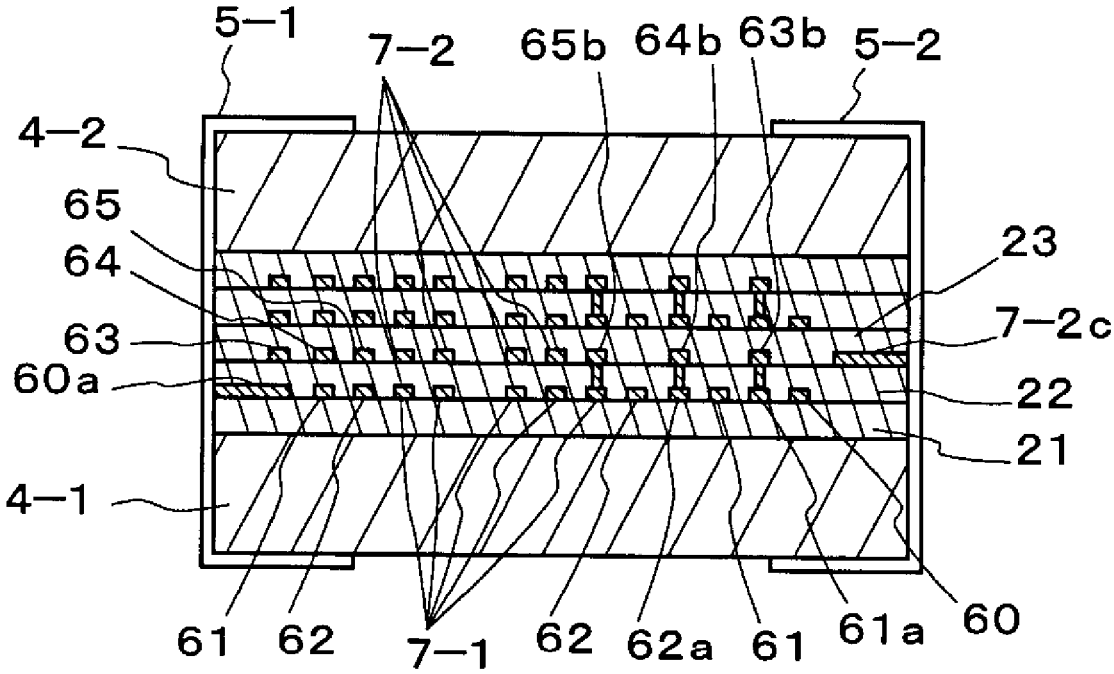
FIG. 3 is a cross-sectional view taken along line A-A in FIG. 2.

FIG. 1 is an exploded perspective view of a coil component according to a first preferred embodiment of the present invention. FIG. 2 is an external view of the coil component. FIG. 3 is a cross-sectional view taken along line A-A in FIG. 2.

The coil component according to the first preferred embodiment functions as a common-mode choke coil that is applicable to a high-speed differential transmission line of DVI standard or HDMI standard. Referring to FIGS. 1 and 2, a coil component 1 includes a first coil block 2 and a second coil block 3 that are sandwiched between a pair of magnetic substrates 4-1, 4-2 so as to form a box-shaped chip body, and four external electrodes 5-1 to 5-4 that are attached to outer surfaces of the chip body.

The first coil block 2 is provided on the magnetic substrate 4-1 and includes a single coil body 2-1 having an outer coil portion 6 and an inner coil portion 7, and an insulating body 2-2 that encompasses the coil body 2-1.

The coil body 2-1 is configured such that the inner coil portion 7 is electrically connected to the outer coil portion 6 while being surrounded by the outer coil portion 6. The outer coil portion 6 and the inner coil portion 7 include a plurality of patterns that are connected to each other.

FIGS. 4A to 4D include plan views showing a structure of the first coil block 2. In order to facilitate an understanding of the illustration, the patterns included in the outer coil portion 6 are shaded.

As will be described later, the insulating body 2-2 (see FIG. 1) of the first coil block 2 includes insulating layers 21 to 23 that are stacked on top of one another. The outer coil portion 6 and the inner coil portion 7 are pattern-formed on the insulating layers 21 to 23.

Figure 4A:
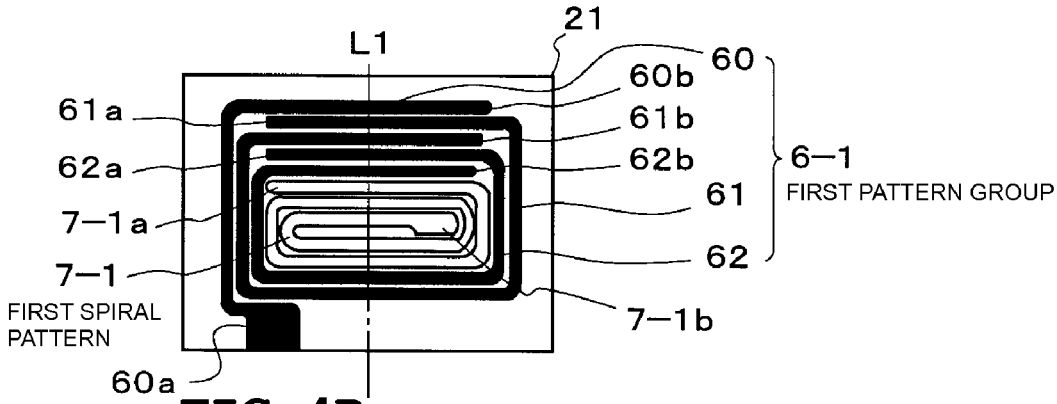
FIGS. 4A to 4D include plan views showing a structure of a first coil block.
Figure 4B:
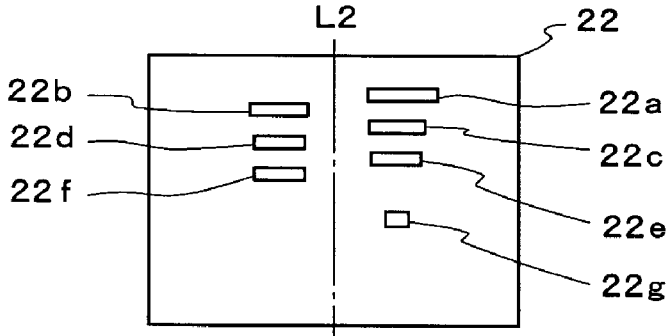
Figure 4C:
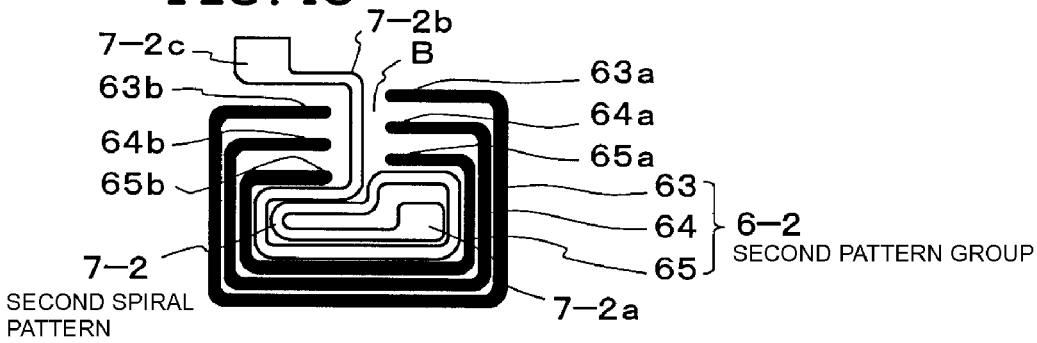
Figure 4D:
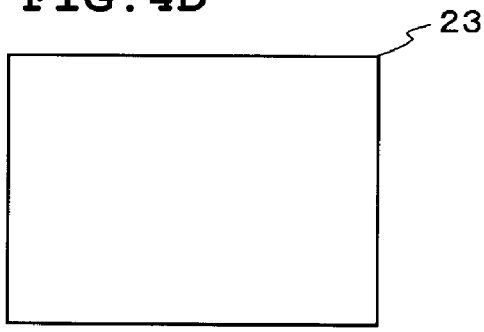

In detail, referring to shaded sections in FIGS. 4A to 4C, the outer coil portion 6 includes a first pattern group 6-1 disposed on the insulating layer 21 and a second pattern group 6-2 disposed on the insulating layer 22.

As shown in FIG. 4A, the first pattern group 6-1 includes substantially rectangular annular patterns 61, 62 disposed on the insulating layer 21 and having different diameters, and a first extending portion 60 disposed outside of the annular patterns 61, 62. Furthermore, each annular pattern 61 (62) has opposite end segments 61*a*, 61*b* (62*a*, 62*b*) that overlap with each other in the vertical direction of the page. While extending along the segments, the first extending portion 60 is bent so as to extend at a left side of a center axis L1. One end segment 60*a* of the first extending portion 60 is disposed on a lower edge of the insulating layer 21 in FIG. 4A and to the left of the center axis L1. Accordingly, the end segment 60*a* of the first extending portion 60 is exposed from the first coil block 2.

Referring to FIG. 4C, the second pattern group 6-2 includes substantially rectangular annular patterns 63, 64, 65 that are disposed on the insulating layer 22. Each annular pattern 63 (64, 65) has opposite end segments 63*a*, 63*b* (64*a*, 64*b*, 65*a*, 65*b*) that are opposed to each other while being separated from each other by a predetermined distance. Specifically, the end segments 63*a*, 64*a*, 65*a* and the end segments 63*b*, 64*b*, 65*b* have a gap B therebetween. The end segments 63*a*, 64*a*, 65*a* and the end segments 63*b*, 64*b*, 65*b* are not completely opposed to each other, but are slightly misaligned from each other in the vertical direction of the page. The end segments 63*a*, 64*a*, 65*a* are substantially aligned with the respective end segments 60*b*, 61*b*, 62*b* of the first extending portion 60 and the annular patterns 61, 62 included in the first pattern group 6-1. The end segments 63*b*, 64*b* are substantially aligned with the end segments 61*a*, 62*a*, respectively. The end segment 65*b* of the annular pattern 65 is a free end.

The first and second pattern groups 6-1, 6-2 face each other across the insulating layer 22 and are electrically connected to each other through via holes 22*a* to 22*f* provided in the insulating layer 22. In detail, the end segment 60*b* of the first extending portion 60 is connected to the free end segment 63*a* of the outermost annular pattern 63 through the via hole 22*a*. The end segment 63*b* of the annular pattern 63 is connected to the end segment 61*a* of the annular pattern 61 through the via hole 22*b*. The end segment 61*b* of the annular pattern 61 is connected to the end segment 64*a* of the annular pattern 64 through the via hole 22*c*. The end segment 64*b* of the annular pattern 64 is connected to the end segment 62*a* of the annular pattern 62 through the via hole 22*d*. The end segment 62*b* of the annular pattern 62 is connected to the end segment 65*a* of the annular pattern 65 through the via hole 22*e*.

With this connection structure, for example, the second outermost annular pattern 62 in the first pattern group 6-1 and the second outermost annular pattern 64 in the second pattern group 6-2 are connected helically to each other via the end segments 62*a*, 64*b*. Moreover, the other end segment 62*b* of the second annular pattern 62 and the end segment 65*a* of the third annular pattern 65 in the second pattern group 6-2 are connected, whereby the second annular pattern 62 and the third annular pattern 65 are helically connected to each other. Similarly, the remaining n-th annular patterns of the first and second pattern groups 6-1, 6-2 are connected helically to each other, and the n-th and (n+1)-th annular patterns of the first and second pattern groups 6-1, 6-2 are also connected helically to each other in the same manner as above. Thus, the entire outer coil portion 6 having the first and second pattern groups 6-1, 6-2 defines an alternating helix in the vertical direction (i.e. front-back direction of the page).

On the other hand, referring to FIGS. 4A and 4C, the inner coil portion 7 includes a first spiral pattern 7-1 provided on the insulating layer 21 and a second spiral pattern 7-2 provided on the insulating layer 22.

In detail, the first spiral pattern 7-1 has a spiral with slightly more than two turns and is disposed within the inner most annular pattern 62 of the first pattern group 6-1. The first spiral pattern 7-1 has an outer end segment 7-1*a* that is connected to the free end segment 65*b* of the innermost annular pattern 65 of the second pattern group 6-2 through the via hole 22*f* in the insulating layer 22. On the other hand, the second spiral pattern 7-2 has a spiral with substantially two turns and is disposed within the innermost annular pattern 65 of the second pattern group 6-2. The second spiral pattern 7-2 has an inner end segment 7-2*a* that is connected to an inner end segment 7-1*b* of the first spiral pattern 7-1 through a via hole 22*g* provided in the insulating layer 22. Moreover, the second spiral pattern 7-2 has a second extending portion 7-2*b* that extends to the left of a center axis L2 through the gap B of the second pattern group 6-2. An end segment 7-2*c* of the second extending portion 7-2*b* is disposed on an upper edge of the insulating layer 22 in the drawing and to the left of the center axis L2. Accordingly, the end segment 7-2*c* is exposed from the first coil block 2 at a position opposite to the end segment 60*a* of the first extending portion 60.

The insulating layer 23 is stacked on the second pattern group 6-2 and the second spiral pattern 7-2, thereby forming the single coil body 2-1 having the helical-shaped outer coil portion 6 and the spiral-shaped inner coil portion 7. Furthermore, the coil body 2-1 is encompassed by the insulating body 2-2 having the insulating layers 21 to 23, thereby forming the first coil block 2.

In the first preferred embodiment, a line length of the outer coil portion 6, or more specifically, a total line length of the first extending portion 60, the annular patterns 61, 62, and the annular patterns 63, 64, 65, is preferably within a range of about ½ to about ⅚ inclusive of a line length of the coil body 2-1, that is, a total length of the patterns 60 to 65 and the first and second spiral patterns 7-1, 7-2.

Referring to FIG. 1, the second coil block 3 has substantially the same structure as the first coil block 2 and includes a single coil body 3-1 having an outer coil portion 6' and an inner coil portion 7', and an insulating body 3-2 that encompasses the coil body 3-1. The second coil block 3 is disposed on the first coil block 2 such that the coil body 3-1 of the second coil block 3 is coaxial with the coil body 2-1 of the first coil block 2.

Although the coil body 3-1 has substantially the same structure as the coil body 2-1, a first extending portion and a second extending portion thereof are disposed at different positions from those of the coil body 2-1.

FIGS. 5A to 5D include plan views showing a structure of the second coil block 3. In order to facilitate an understanding of the illustration, the patterns included in the outer coil portion 6' are shaded.

Referring to FIG. 1, the coil body 3-1 of the second coil block 3 includes first and second pattern groups 6-1', 6-2' of the outer coil portion 6' and first and second spiral patterns 7-1', 7-2' of the inner coil portion 7', which are pattern-formed on insulating layers 23 to 25 included in the insulating body 3-2.

Figure 5A:
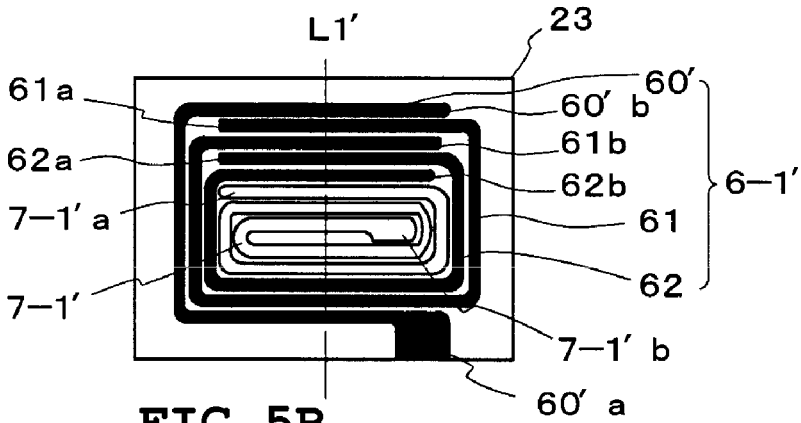
FIGS. 5A to 5D include plan views showing a structure of a second coil block.
Figure 5B:
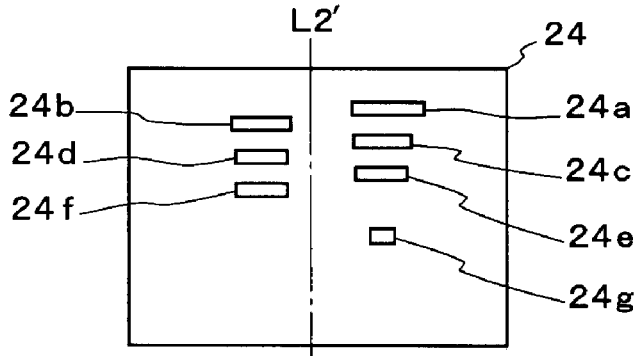
Figure 5C:
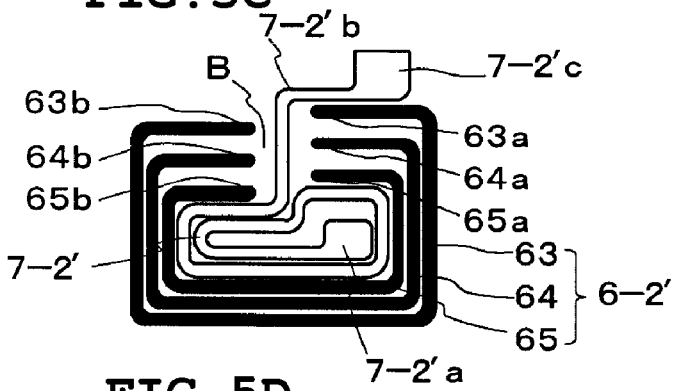
Figure 5D:
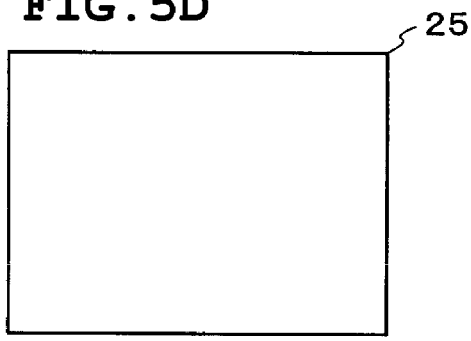

Specifically, referring to FIG. 5A the first pattern group 6-1' of the outer coil portion 6' (see FIG. 1) and the first spiral pattern 7-1' of the inner coil portion 7' (see FIG. 1) are pattern-formed on the insulating layer 23. Moreover, referring to FIGS. 5B and 5C, the second pattern group 6-2' of the outer coil portion 6' and the second spiral pattern 7-2' of the inner coil portion 7' are pattern-formed on the insulating layer 24.

The outer coil portion 6' includes a first extending portion 60' and annular patterns 61, 62 in the first pattern group 6-1' that are helically connected to annular patterns 63, 64, 65 in the second pattern group 6-2' through corresponding via holes 24*a* to 24*f* provided in the insulating layer 24. On the other hand, the inner coil portion 7' includes the first spiral pattern 7-1' and the second spiral pattern 7-2' that are connected to each other in series through a via hole 24*g*.

Furthermore, the first extending portion 60' extends to the right of a center axis L1' of the insulating layer 23 and has an end segment 60'*a* that is exposed from the second coil block 3. On the other hand, a second extending portion 7-2'*b* extending through the gap B is bent to the right of a center axis L2' of the insulating layer 24 and has an end segment 7-2'*c* which is exposed from the second coil block 3.

The insulating layer 25 is stacked on the second pattern group 6-2' and the second spiral pattern 7-2', thereby forming the second coil block 3.

In the second coil block 3, a line length of the outer coil portion 6' is preferably within a range of about ½ to about ⅚ inclusive of a line length of the coil body 3-1.

Referring to FIG. 1, the magnetic substrate 4-2 is adhered to the insulating layer 25 of the second coil block 3 with an adhesive 40, thereby forming a box-shaped chip body. The external electrodes 5-1 to 5-4 are attached to outer surfaces of the chip body, such that the external electrodes 5-1, 5-2 are respectively connected to the end segments 60*a*, 7-2*c* of the coil body 2-1 and that the external electrodes 5-3, 5-4 are respectively connected to the end segments 60'*a*, 7-2'*c* of the coil body 3-1.

A manufacturing process of the coil component 1 will be described below with reference to FIG. 1.

The coil component 1 according to the first preferred embodiment is a laminated wafer that is formed by alternately stacking the first pattern group 6-1 and the first spiral pattern 7-1, the second pattern group 6-2 and the second spiral pattern 7-2, the first pattern group 6-1' and the first spiral pattern 7-1', the second pattern group 6-2' and the second spiral pattern 7-2', and the insulating layers 21 to 25 onto the magnetic substrate 4-1, and then adhering the magnetic substrate 4-2 onto the uppermost layer. For each of the layers, the following materials are used.

The magnetic substrates 4-1, 4-2 are used as substrates. In order to allow a subsequent photolithography process to be performed without difficulty, the magnetic substrate 4-1 is preferably polished so that its surface roughness Ra is about 0.5 μm or less. Alternatively, although magnetic substrates are used in the first preferred embodiment, dielectric substrates or insulating substrates may be used depending on the intended use of the coil component.

As an insulating material for forming the insulating layers 21 to 25, a resin material such as polyimide resin, epoxy resin, and benzocyclobutene resin, a glass material such as $SiO_2$, a glass-ceramic material, a dielectric material, or a combination of different materials may be used. Since a photolithography technique is used in the first preferred embodiment, photosensitive polyimide resin is used as a material for forming the insulating layers 21 to 25.

As a conductive material used for forming the first and second pattern groups 6-1, 6-2, 6-1', 6-2' and the first and second spiral patterns 7-1, 7-2, 7-1', 7-2', a highly conductive metallic material such as Ag, Pd, Cu, and Al, or an alloy of these metallic materials maybe used. In the first preferred embodiment, Ag is preferably used. The combination between an insulating material and a conductive material is preferably selected based on, for example, workability and adhesiveness.

Furthermore, thermosetting polyimide resin is used as the adhesive 40.

In the manufacturing process of the coil component 1, an insulating material is first applied over the magnetic substrate 4-1 and is photo-cured so as to form the insulating layer 21 (first insulating layer). Then, a film composed of a conductive material is formed over the insulating layer 21 by a thin-film formation technique, such as sputtering and vapor deposition, or by a thick-film formation technique, such as screen printing. Subsequently, a photolithography process including a series of steps, such as a resist coating step, an exposure step, a developing step, an etching step, and a resist removal step, is performed so as to form the first pattern group 6-1 and the first spiral pattern 7-1 on the insulating layer 21. Then, an insulating material is applied over the first pattern group 6-1 and the first spiral pattern 7-1 so as to form the insulating layer 22 (second insulating layer) provided with the via holes 22*a* to 22*g* by photolithography. Subsequently, a film composed of a conductive material is formed over the insulating layer 22, and then the second pattern group 6-2 and the second spiral pattern 7-2 are formed on the insulating layer 22 by photolithography. Thus, the second pattern group 6-2 and the second spiral pattern 7-2 of the upper layer and the first pattern group 6-1 and the first spiral pattern 7-1 of the lower layer are electrically connected through the via holes 22*a* to 22*g*. Accordingly, this forms the first coil block 2 having the coil body 2-1 encompassed by the insulating body 2-2.

In the same manner as described above, the insulating layers 23 to 25, the first and second pattern groups 6-1', 6-2', and the first and second spiral patterns 7-1', 7-2' are alternately stacked on top of one another, thereby forming the second coil block 3 having the coil body 3-1 encompassed by the insulating body 3-2. Subsequently, the magnetic substrate 4-2 having the adhesive 40 applied thereon is adhered to the insulating layer 25 of the second coil block 3. In this state, a heating-compressing process is performed in a vacuum or in an inert gas, and then a cooling process is performed. After the cooling process, the pressure is released, whereby the magnetic substrate 4-2 is securely joined to the second coil block 3.

Subsequently, a wafer obtained by the above-described process is subject to cutting, such as dicing, so as to be split into approximately 0.8 mm×0.6 mm sized chip bodies, for example. Then, the external electrodes 5-1 to 5-4 are formed on each chip body. In this case, each of the external electrodes 5-1 to 5-4 is preferably formed by first forming a first metallic film by applying a conductive paste including a material of, for example, AG, Ab-Pd, Cu, NiCr, or NiCu, orby sputtering or vapor depositing the material, and then forming a second metallic film composed of, for example, Ni, Sn, or Sn—Pb over the first metallic film by wet electrolytic plating.

Accordingly, since a photolithography technique is used in the manufacturing process of the coil component 1, the stray capacitance and the line length can be controlled with high precision, thereby enabling manufacturing of a high-precision coil component 1.

The operation and advantages of the coil component 1 according to the first preferred embodiment will now be described.

Figure 6:
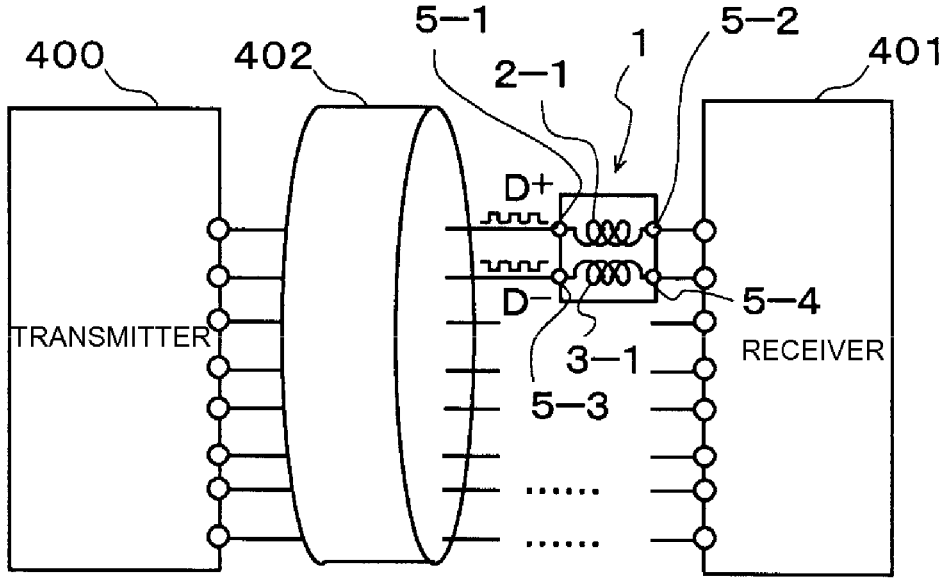
FIG. 6 is a schematic diagram showing a state where the coil component is incorporated in a high-speed differential transmission line of DVI standard or HDMI standard.

FIG. 6 is a schematic diagram showing a state in which the coil component 1 is incorporated in a high-speed differential transmission line of DVI standard or HDMI standard.

As shown in FIG. 6, a transmitter 400 of a personal computer is connected to a receiver 401 on a monitor side via a cable 402. The following description is directed to a case in which the coil component 1 is incorporated in a high-speed differential transmission line of DVI standard or HDMI standard that transmits digital differential signals D+, D− from the transmitter 400 to the receiver 401. In a transmission type of DVI standard or HDMI standard, a pair of clock differential signals and three pairs of data differential signals D+, D− are typically transmitted. However, in order to facilitate an understanding, the description below will refer only to a line that transmits one of the pairs of differential signals D+, D− and will therefore be directed to an example in which the coil component 1 is incorporated in this line.

In FIG. 6, the coil component 1 functions as a common-mode choke coil. Specifically, in a normal mode, a differential signal D+ is input to the coil body 2-1 through the external electrode 5-1 and is then output from the external electrode 5-2. On the other hand, a differential signal D− of an opposite phase is input to the coil body 3-1 through the external electrode 5-3 and is then output from the external electrode 5-4. In this case, the differential signal D+ input to the coil body 2-1 through the external electrode 5-1 travels helically through the outer coil portion 6 and then travels through the inner coil portion 7 in a rotating manner so as to reach the external electrode 5-2. On the other hand, due to having an opposite phase to the differential signal D+, the differential signal D− input to the coil body 3-1 through the external electrode 5-4 travels through the inner coil portion 7' in a rotating manner and then travels helically through the outer coil portion 6' so as to reach the external electrode 5-3. Consequently, since the differential signals D+, D− travel in opposite directions, a magnetic field within the coil component 1 is decreased, whereby the impedance in the coil component 1 is reduced. Thus, the differential signals D+, D− are transmitted through the coil component 1 without attenuation.

On the other hand, in a common mode, since noise enters the coil bodies 2-1, 3-1 from the same direction, the magnetic field increases, thereby allowing the coil component 1 to have an increased impedance. Thus, the noise is attenuated by the coil component 1.

Referring back to FIG. 1, the coil component 1 is a multilayer component, and in the coil body 2-1 (3-1), the second pattern group 6-2 and the second spiral pattern 7-2 forming the upper layer and the first pattern group 6-1 and the first spiral pattern 7-1 forming the lower layer (the first and second pattern groups 6-1', 6-2' and the first and second spiral patterns 7-1', 7-2') face each other. Therefore, stray capacitance generated between these patterns may be of concern. In other words, if the stray capacitance is high, the self-resonance frequency of the coil body 2-1 (3-1) is low, thus lowering the impedance against high frequency noise and significantly deteriorating the noise attenuation effect. In particular, the most problematic stray capacitance is the stray capacitance generated between outer periphery patterns that have large line lengths.

However, the coil component 1 according to the first preferred embodiment operates so as to reduce stray capacitance.

Figure 7:
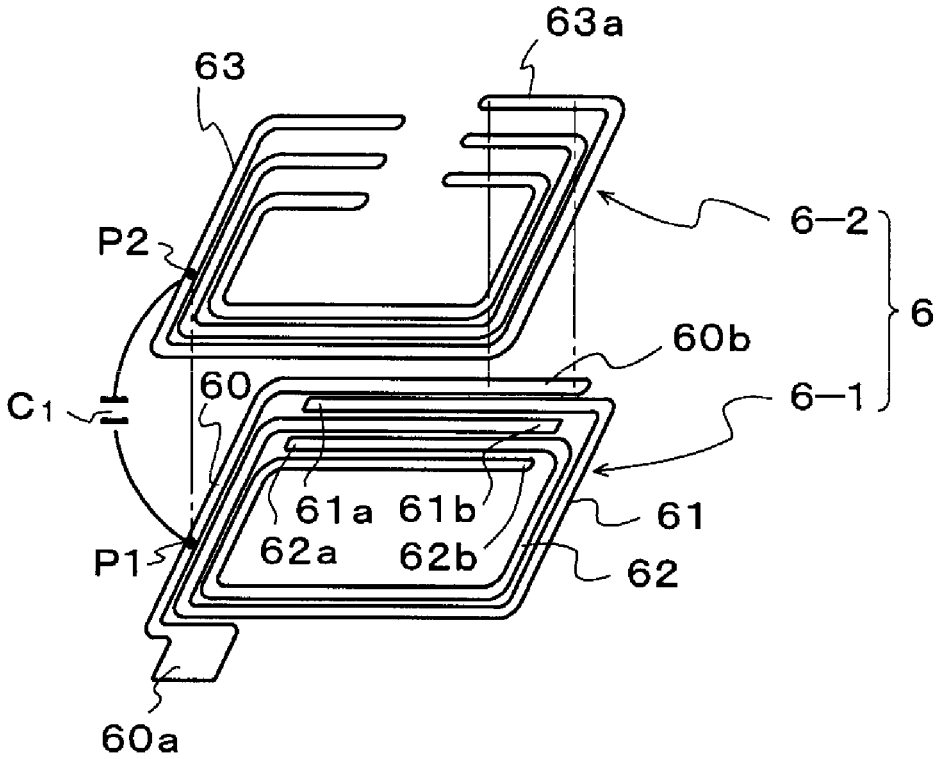
FIG. 7 is a perspective view of an outer coil portion for illustrating a stray-capacitance reducing effect.

FIG. 7 is a perspective view of the outer coil portion 6 for illustrating such a stray-capacitance reducing effect.

As shown in FIG. 7, stray capacitance C1 generated between a point P1 on the outermost first extending portion 60 in the first pattern group 6-1 and a point P2 on the annular pattern 63 in the second pattern group 6-2, which faces the point P1, is dependent upon a line length between the point P1 and the point P2. Due to the connection between the end segment 60*a* and the end segment 63*a*, the outermost first extending portion 60 is helically connected to the annular pattern 63. Thus, the line length between the point P1 and the point P2 is equal to a sum of a line between the point P1 and the end segment 60*b* of the first extending portion 60 and a line between the end segment 63*a* and the point P2 of the annular pattern 63. This enables the line length between the point P1 and the point P2 to be extremely short. Therefore, a potential difference between the point P1 and the point P2 is small, whereby the stray capacitance C1 is extremely low, that is, the total stray capacitance generated in the outer coil portion 6 is very low. However, in the outer coil portion 6, the end segments 61*a*, 61*b* (62*a*, 62*b*) of each annular pattern 61 (62) overlap each other in the vertical direction of the page. Thus, in the miniature coil component 1, a sufficient number of turns cannot be obtained solely with the outer coil portion 6 due to limitations of space, which implies that sufficient inductance cannot be obtained with only the outer coil portion 6. The first preferred embodiment solves this problem by disposing the inner coil portion 7 within the outer coil portion 6 to omit unnecessary overlapping sections so as to achieve high inductance within a small space.

In other words, as shown in FIG. 1, the outer coil portion 6 with low stray capacitance is disposed in an outer region of the coil body 2-1 to increase the self-resonance frequency, and the inner coil portion 7 that is capable of obtaining high inductance is disposed in an inner region of the coil body 2-1, thereby achieving lower stray capacitance and higher inductance in the coil body 2-1. Such an advantage is similarly achieved by the outer coil portion 6' and the inner coil portion 7' of the coil body 3-1. Accordingly, the coil component 1 functions as a common-mode choke coil having a high frequency property.

In the coil component 1 having the above-described structure, a fraction of the coil body 2-1 (3-1) occupied by the line length of the outer coil portion 6 (6') is related to the self-resonance frequency of the coil component 1 or to the common-mode impedance.

Figure 8:
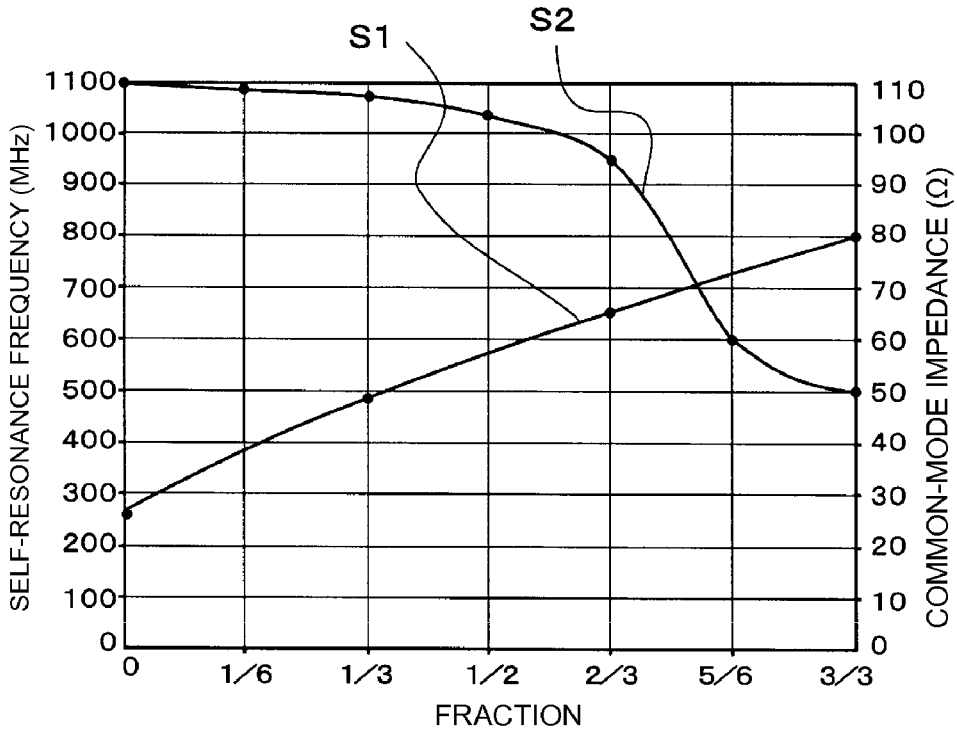
FIG. 8 is a graph that shows relationships among a fraction of a total line length of a coil body occupied by a line length of the outer coil portion, a self-resonance frequency, and common-mode impedance.

FIG. 8 is a graph that shows the relationships among a fraction of a total line length of the coil body 2-1 (3-1) occupied by the line length of the outer coil portion 6 (6'), a self-resonance frequency of the coil component 1, and common-mode impedance in a common mode according to the miniature coil component 1 having a size of approximately 0.8 mm×0.6 mm. A curve S1 corresponds to a self-resonance frequency curve, and a curve S2 corresponds to a common-mode impedance curve.

According to the self-resonance frequency curve S1 in FIG. 8, a self-resonance frequency of the coil component 1 increases as the fraction occupied by the outer coil portion 6 (6') increases. In contrast, as is clear from the common-mode impedance curve S2, the impedance in a common mode decreases as the fraction increases.

Therefore, in view of a transmission line in which the coil component 1 is to be incorporated, it is necessary to determine an appropriate fraction occupied by the outer coil portion 6 (6') so that both high self-resonance frequency (low stray capacitance) of the coil component 1 and high impedance (high inductance) in a common mode can be achieved. Since the coil component 1 according to the first preferred embodiment is intended to be incorporated into a high-speed differential transmission line of DVI standard or HDMI standard, a self-resonance frequency of about 580 MHz to about 720 MHz and a common-mode impedance of at least about 60 Ω are desirably attained. Consequently, a fraction occupied by the line length of the outer coil portion 6 (6') is preferably set within a range of about ½ to about ⅚ inclusive of the line length of the coil body 2-1 (3-1).

In this respect, the inventors of the present invention measured a frequency characteristic of the coil component 1 in which the fraction occupied by the outer coil portion 6 (6')

is set within the above-described range and a frequency characteristic of a coil component of a conventional type.

Figure 9:
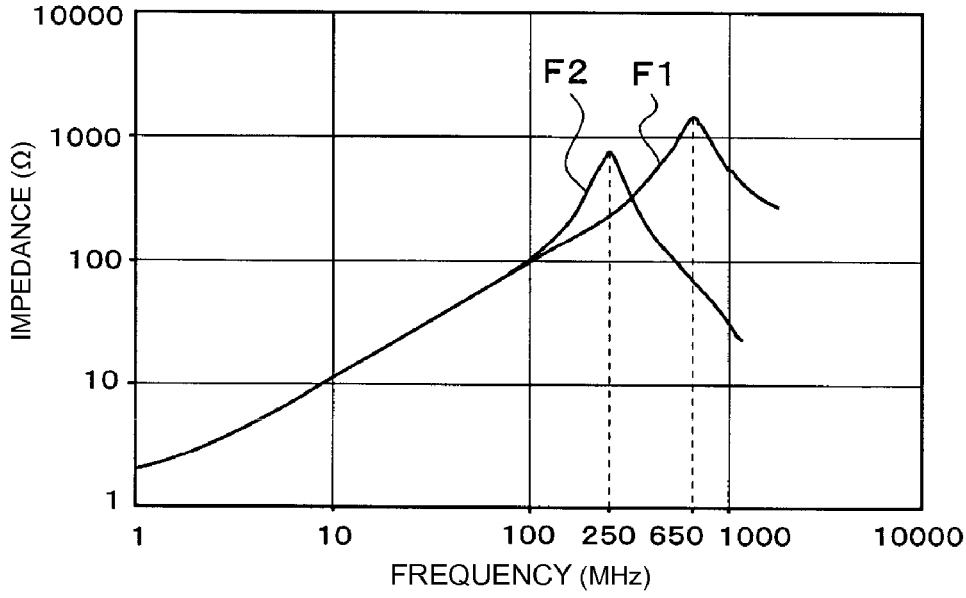
FIG. 9 is a graph that shows a frequency characteristic of the coil component according to the first preferred embodiment and a frequency characteristic of a coil component of a conventional type.

FIG. 9 is a graph that shows the frequency characteristic of the coil component 1 according to the first preferred embodiment and the frequency characteristic of the coil component of the conventional type.

For the measurement of the frequency characteristic, the coil component 1 of the first preferred embodiment having a size of approximately 0.8 mm×0.6 mm was used, and a fraction occupied by the outer coil portion 6 (6') was set to about 7/10. As a result, a frequency curve F1 having a peak at a frequency of about 650 MHz was obtained, as shown in FIG. 9. In other words, it was proven that the coil component 1 has a high self-resonance frequency of about 650 MHz.

Figure 13:
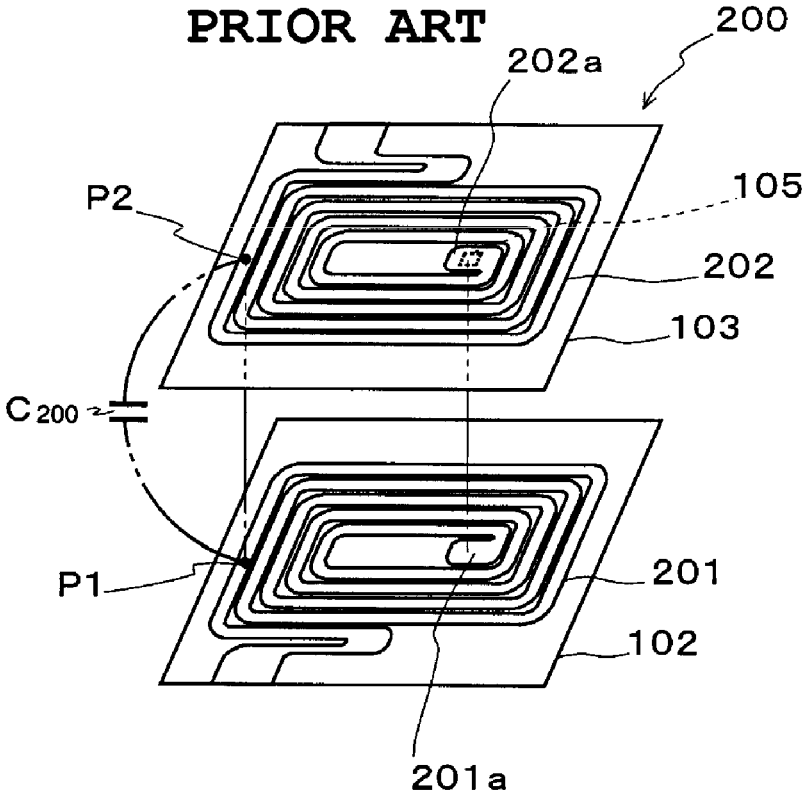
FIG.13 PRIOR ART
FIG. 13 is an exploded perspective view of a coil component according to a second conventional example.
Figure 14:
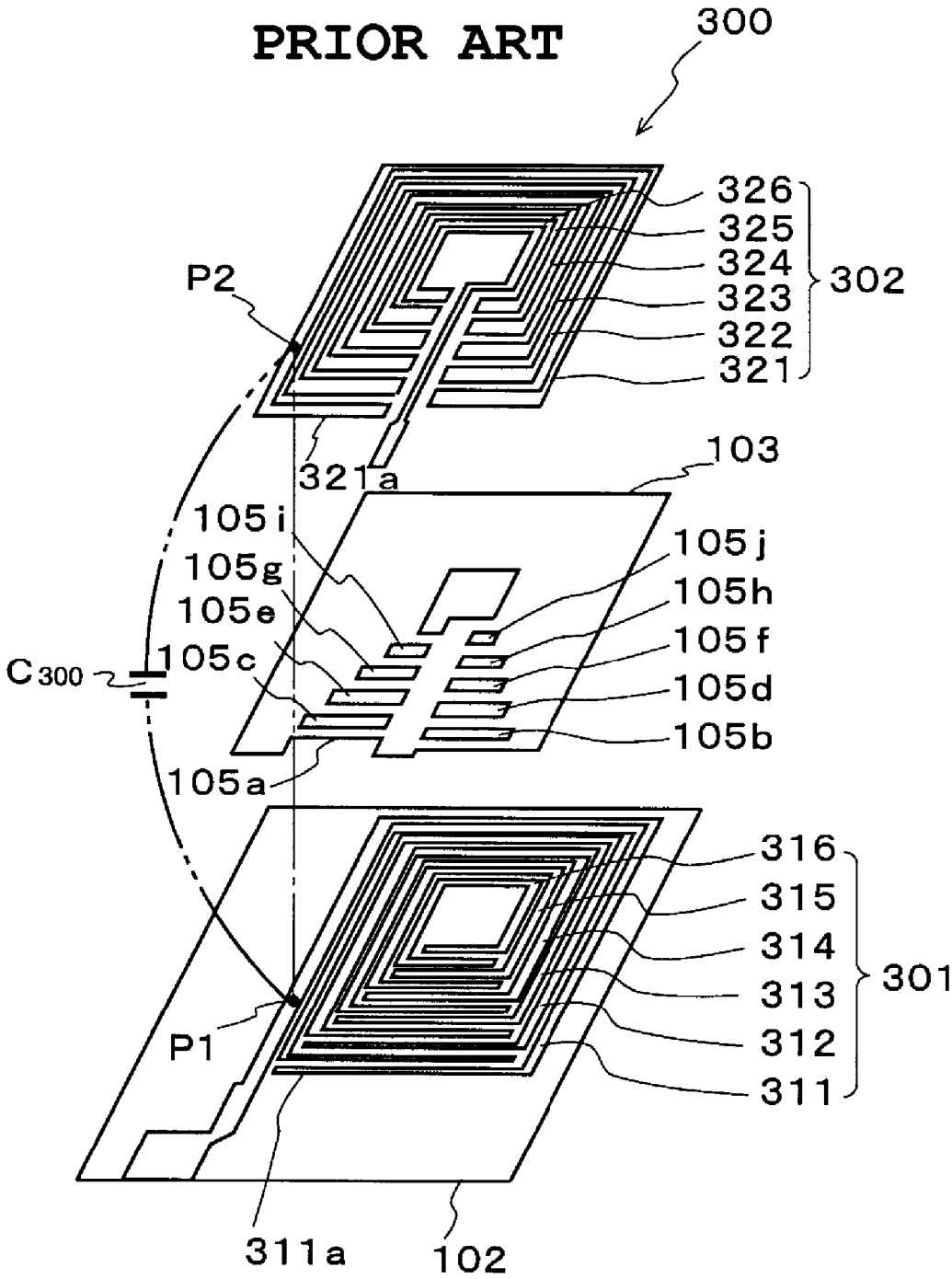
FIG. 14 PRIOR ART
FIG. 14 is an exploded perspective view of a coil component according to a third conventional example.

In contrast, a frequency characteristic of a coil component in which each coil body 2-1 (3-1) is entirely formed of a spiral pattern, as in the conventional coil component 200 (see FIG. 13), was measured. As a result, a frequency curve F2 was obtained, which shows that the coil component has an extremely low self-resonance frequency of 250 MHz.

Second Preferred Embodiment

A second preferred embodiment of the present invention will now be described.

FIGS. 10A to 10D include plan views of a first coil block, which is a relevant portion of a coil component 1' according to the second preferred embodiment of the present invention. FIGS. 11A and 11B include cross-sectional views illustrating an electromagnetic coupling between coil bodies.

In the second preferred embodiment, with respect to densities of pattern units including the first pattern groups 6-1 (6-1') and the first spiral patterns 7-1 (7-1') and densities of pattern units including the second pattern groups 6-2 (6-2') and the second spiral patterns 7-2 (7-2') in the coil bodies 2-1 (3-1), the second coil block 3 is stacked on the first coil block 2 such that the pattern unit with the higher density in one coil body is disposed facing the pattern unit with the higher density in the other coil body.

For example, referring to FIG. 1, the density of the pattern unit including the first pattern group 6-1 (6-1') and the first spiral pattern 7-1 (7-1') is higher than the density of the pattern unit including the second pattern group 6-2 (6-2') and the second spiral pattern 7-2 (7-2'). Therefore, in the second preferred embodiment, the pattern unit including the first pattern group 6-1 and the first spiral pattern 7-1 of the coil body 2-1 is disposed facing the pattern unit including the first pattern group 6-l' and the first spiral pattern 7-1' of the coil body 3-1.

In detail, referring to FIGS. 10A to 10D, a multilayer structure of the first coil block 2 is an inversion of the multilayer structure of the first coil block in the first preferred embodiment shown in FIGS. 4A to 4D.

Figure 10A:
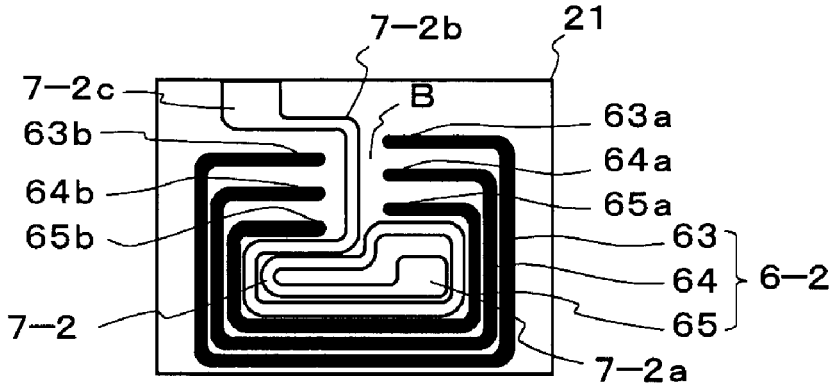
FIGS. 10A to 10D include plan views of a first coil block, which is a relevant portion of a coil component according to a second preferred embodiment of the present invention.
Figure 10B:
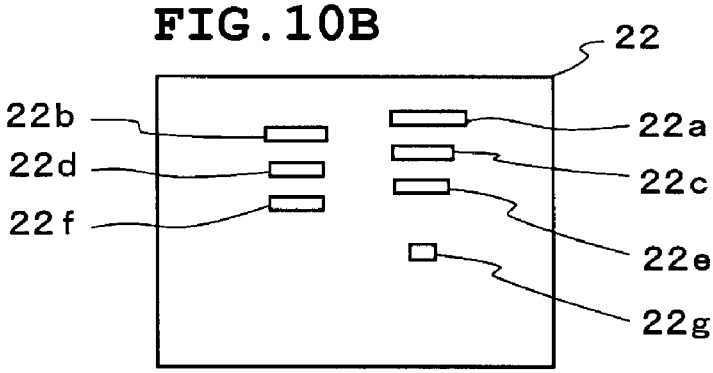
Figure 10C:
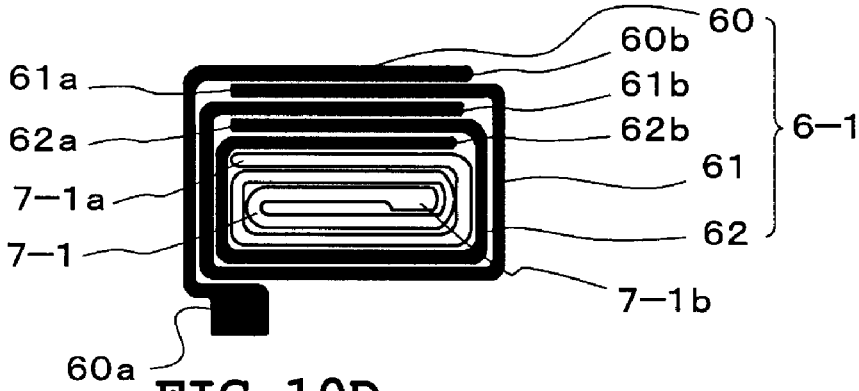
Figure 10D:
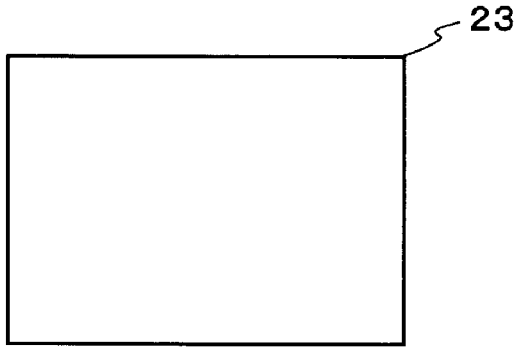
Figure 11A:
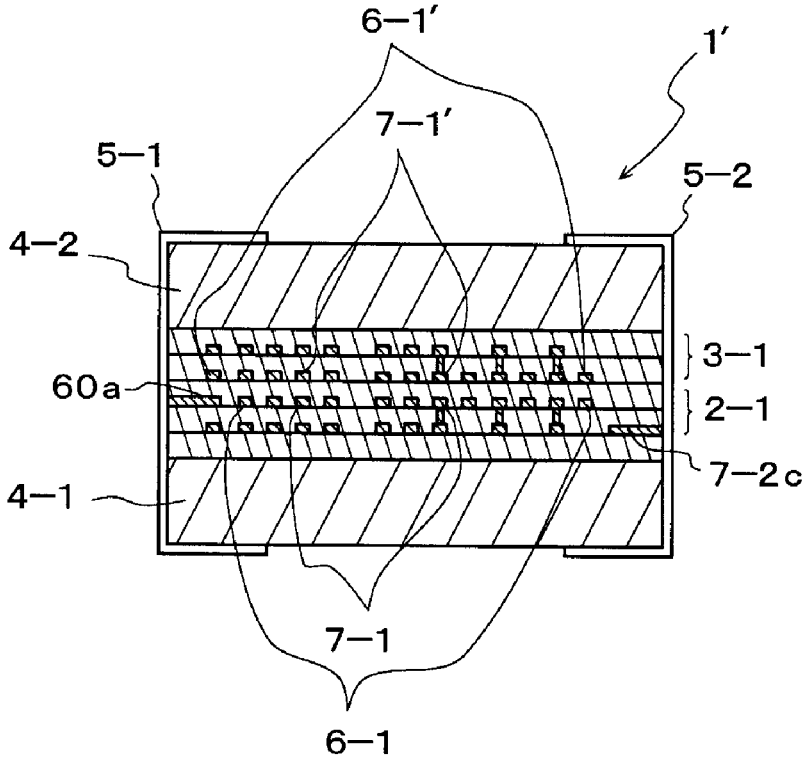
FIGS. 11A and 11B include cross-sectional views illustrating an electromagnetic coupling between coil bodies.
Figure 11B:
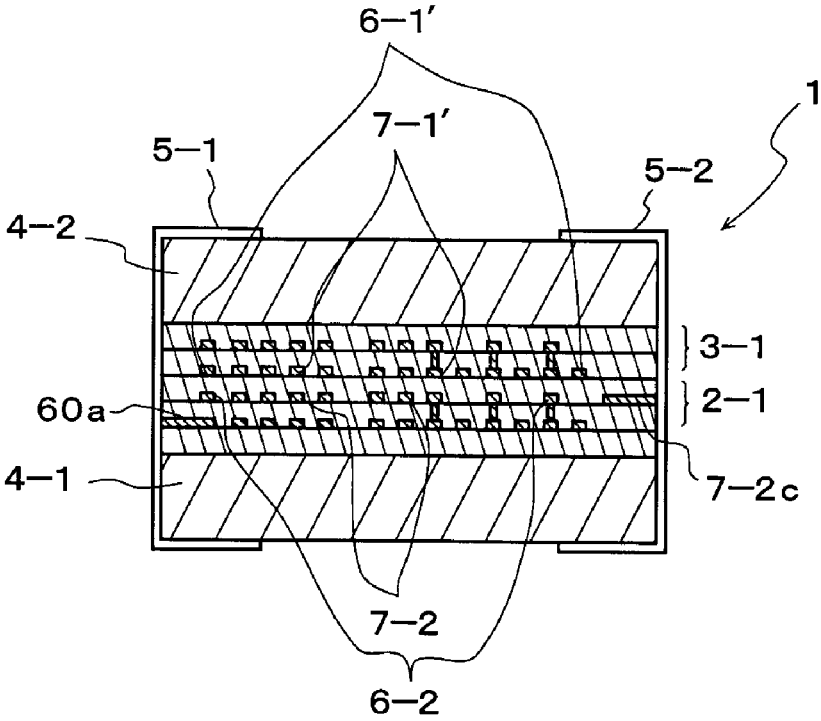
Figure 12:
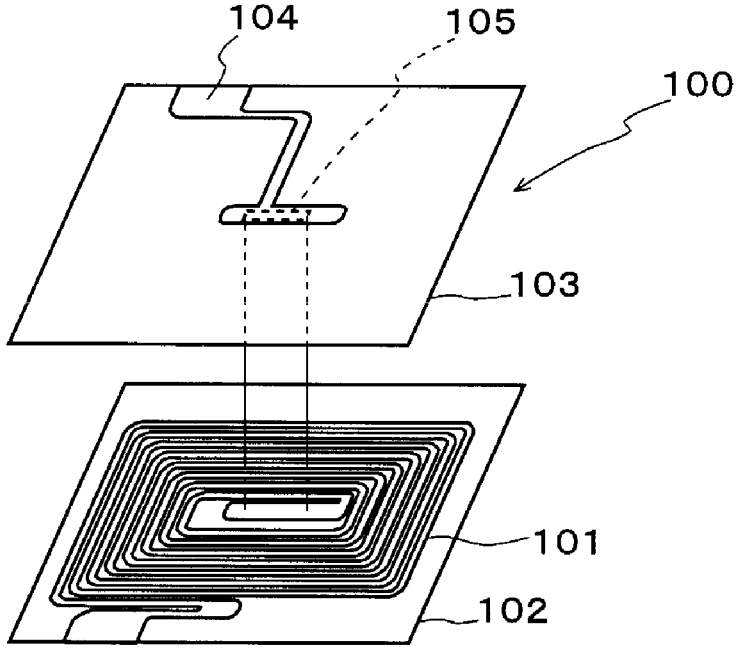
FIG.12 PRIOR ART
FIG. 12 is an exploded perspective view of a coil component according to a first conventional example.

In other words, as shown in FIG. 10A, the second pattern group 6-2 and the second spiral pattern 7-2 are formed on the bottommost insulating layer 21. Furthermore, as shown in FIGS. 10B and 10C, the first pattern group 6-1 and the first spiral pattern 7-1 are formed on the insulating layer 22. The second pattern group 6-2 and the second spiral pattern 7-2 are electrically connected to the first pattern group 6-1 and the first spiral pattern 7-1 through the corresponding via holes 22*a* to 22*f*. Moreover, as shown in FIG. 10D, the insulating layer 23 is stacked over the first pattern group 6-1 and the first spiral pattern 7-1.

Accordingly, as shown in FIG. 11A, the higher-density pattern unit including the first pattern group 6-1 and the first spiral pattern 7-1 of the coil body 2-1 is disposed facing the higher-density pattern unit including the first pattern group 6-1' and the first spiral pattern 7-1' of the coil body 3-1, thereby strengthening the electromagnetic coupling between the coil body 2-1 and the coil body 3-1.

As a result, when the coil component 1' in the second preferred embodiment is used as a common-mode choke coil, the normal-mode impedance of the coil component 1' is reduced. Consequently, an insertion loss of a differential signal in a normal mode is reduced, thereby effectively removing only common-mode noise while preventing attenuation of the differential signal.

In contrast, the coil component 1 in the first preferred embodiment has the structure as shown in FIG. 11B in which the lower-density pattern unit including the second pattern group 6-2 and the second spiral pattern 7-2 of the coil body 2-1 is disposed facing the higher-density pattern unit including the first pattern group 6-1' and the first spiral pattern 7-1' of the coil body 3-1. In other words, the coil component 1' according to the second preferred embodiment is modified such that the degree of electromagnetic coupling is much higher than that of electromagnetic coupling between the coil bodies 2-1, 3-1 in the coil component 1 according to the first preferred embodiment.

Other configurations, operations, and advantages of the second preferred embodiment are substantially the same as those in the first preferred embodiment, and therefore will not be described here.

The technical scope of the present invention is not limited to the above-described preferred embodiments, and modifications are permissible within the scope and spirit of the present invention.

For example, although a fraction occupied by the line length of the outer coil portion 6 (6') of the coil component 1 is preferably within a range of about ½ to about 5/6 inclusive of the line length of the coil body 2-1 (3-1) in the above-described preferred embodiments, the fraction is not limited within this range. In other words, in a typical high-speed differential transmission line, such as a USB (universal serial bus), it is satisfactory as long as noise primarily within a range of about 200 MHz to about 500 MHz can be effectively attenuated. This can be sufficiently achieved by setting the fraction occupied by the line length of the outer coil portion 6 (6') of the coil component 1 to at least about ⅓ of the line length of the coil body 2-1 (3-1).

Furthermore, although the first and second coil blocks 2, 3 preferably define the coil component 1 in order to allow the coil component 1 to function as a common-mode choke coil in the above-described preferred embodiments, the present invention may alternatively include a coil component having a single coil block, as in a ferrite bead.

Furthermore, although the magnetic substrates 4-1, 4-2 are included in the above-described preferred embodiments, this does not mean that a coil component not having these substrates or a coil component having only a single substrate is excluded from the scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A coil component comprising:

at least one coil block having a single coil body disposed within an insulating body, the single coil body including an inner coil portion and an outer coil portion, the inner coil portion being electrically connected to the outer coil portion while being surrounded by the outer coil portion; wherein the outer coil portion includes a first pattern group and a second pattern group that are disposed facing each other, the first pattern group including a plurality of annular patterns having different diameters and each having first and second opposite end segments, and also including a first extending portion disposed outside of the plurality of annular patterns and having a first end segment that is exposed from said at least one coil block, the second pattern group including a plurality of annular patterns having different diameters and each having first and second opposite end segments, wherein the n-th annular pattern of the first pattern group from the outside thereof is helically connected to the n-th annular pattern of the second pattern group from the outside thereof via the first end segments, wherein the second end segment of the n-th annular pattern of the first pattern group is connected to one of the end segments of the (n+1)-th annular pattern of the second pattern group such that the n-th and (n+1)-th annular patterns are helically connected to each other, and wherein the first extending portion has a second end segment that is connected to a free end segment of the outermost annular pattern of the second pattern group; and the inner coil portion includes a first multi-turn spiral pattern and a second multi-turn spiral pattern, the first spiral pattern being disposed within the innermost annular pattern of the first pattern group and having an outer end segment that is connected to a free end segment of the innermost annular pattern of the second pattern group, the second spiral pattern being disposed within the innermost annular pattern of the second pattern group, the second spiral pattern having an inner end segment that is connected to an inner end segment of the first spiral pattern and also having a second extending portion having an outer end segment that is exposed from said at least one coil block.

2. The coil component according to claim 1, wherein a line length of the outer coil portion is at least about ⅓ of a line length of the single coil body.

3. The coil component according to claim 1, wherein said at least one coil block has a multilayer structure including a first insulating layer on which the first pattern group and the first spiral pattern are disposed, and a second insulating layer stacked on the first pattern group and the first spiral pattern, the second insulating layer including the second pattern group and the second spiral pattern disposed thereon; and the second insulating layer includes a plurality of via holes through which the end segments of the annular patterns in the first pattern group are connected to the corresponding end segments of the annular patterns in the second pattern group, through which the outer end segment of the first spiral pattern is connected to the free end segment of the innermost annular pattern of the second pattern group, and through which the inner end segment of the second spiral pattern is connected to the inner end segment of the first spiral pattern.

4. The coil component according to claim 3, wherein said at least one coil block is formed by a photolithography technique.

5. The coil component according to claim 3, wherein said at least one coil block is disposed on a substrate.

6. The coil component according to claim 1, wherein said at least one coil block comprises a first coil block and a second coil block, the second coil block being stacked on the first coil block in a manner such that the coil body of the second coil block is coaxial with the coil body of the first coil block.

7. The coil component according to claim 6, wherein the first coil block is disposed on a magnetic substrate and another magnetic substrate is disposed on the second coil block.

8. The coil component according to claim 6, wherein the first pattern group and the first spiral pattern define a pattern unit in the coil body of each of the first and second coil blocks, and the second pattern group and the second spiral pattern define another pattern unit in the coil body of each of the first and second coil blocks, and wherein the second coil block is stacked on the first coil block in a manner such that one of the pattern units with a higher density in the second coil block is disposed facing one of the pattern units with a higher density in the first coil block.

* * * * *